US012599205B1

(12) United States Patent
Gurunlian

(10) Patent No.: US 12,599,205 B1
(45) Date of Patent: Apr. 14, 2026

(54) METHOD OF JOINING TITANIUM AND PRECIOUS METAL AND PRODUCTS OF SAME

(71) Applicant: Mike Gurunlian, Palos Verdes Peninsula, CA (US)

(72) Inventor: Mike Gurunlian, Palos Verdes Peninsula, CA (US)

( * ) Notice: Subject to any disclaimer, the term of this patent is extended or adjusted under 35 U.S.C. 154(b) by 0 days.

(21) Appl. No.: 19/072,745

(22) Filed: Mar. 6, 2025

Related U.S. Application Data

(60) Provisional application No. 63/562,851, filed on Mar. 8, 2024.

(51) Int. Cl.

| | |
|---|---|
| ***A44C 27/00*** | (2006.01) |
| ***B22C 9/22*** | (2006.01) |
| ***B22D 25/00*** | (2006.01) |
| ***B22D 25/02*** | (2006.01) |

(52) U.S. Cl.
CPC ..... *A44C 27/002* (2013.01); *B22C 9/22* (2013.01); *B22D 25/026* (2013.01)

(58) Field of Classification Search
CPC . B29C 70/00; B29C 45/14008; B29C 37/001; B29C 31/008; B29C 33/0044; B29C 2045/1454; B29C 2045/14139; B29C 2045/14122; B29C 2045/14131; B22D 25/026; A44C 27/002; B22C 9/22
See application file for complete search history.

(56) References Cited

U.S. PATENT DOCUMENTS

| | | | | | |
|---|---|---|---|---|---|
| 1,641,923 | A * | 9/1927 | Howlett | B29C 33/16 | 425/436 RM |
| 3,077,003 | A * | 2/1963 | Hobson | B29C 45/14 | 425/129.1 |
| 3,610,317 | A * | 10/1971 | Benfield | B22C 9/04 | 164/249 |
| 4,158,910 | A * | 6/1979 | Hanas | B29C 45/2673 | 425/451.2 |
| 4,268,003 | A * | 5/1981 | Liautaud | B29C 45/14 | 264/328.8 |
| 5,198,172 | A * | 3/1993 | Spoo | B29C 33/306 | 264/258 |
| 5,318,093 | A * | 6/1994 | MacDonald | B22D 25/026 | 164/160.1 |
| 5,344,600 | A * | 9/1994 | McShane | B29C 45/14655 | 264/272.17 |
| 6,076,258 | A * | 6/2000 | Abe | B29C 45/14065 | 29/874 |

(Continued)

*Primary Examiner* — Emmanuel S Luk
(74) *Attorney, Agent, or Firm* — Concourse Law Group; Katherine B. Sales, Esq.

(57) ABSTRACT

A method of joining titanium and precious metal, the method comprising the steps of: a) providing a titanium pin or tube; b) providing a mold having a brass insert, c) placing the shaft of the pin or tube through the brass insert and into a corresponding hole in mold; e) closing the mold; f) injecting plastic into the mold and forming at least one plastic branch; g) forming a complete product using the lost wax method of casting. A metal composite comprising: a) a precious metal body portion; and b) a cylindrical titanium portion having a shaft portion and a head portion, wherein the head portion is embedded within the precious metal body. A mold used to join titanium and precious metal, the mold comprising two halves and a brass insert.

11 Claims, 12 Drawing Sheets

(56) References Cited

U.S. PATENT DOCUMENTS

| | | | | |
|---|---|---|---|---|
| 6,527,989 | B1 * | 3/2003 | Onoda | B29C 45/14639 264/277 |
| 6,780,067 | B1 * | 8/2004 | Kono | B29C 39/10 264/272.17 |
| 2004/0134880 | A1 * | 7/2004 | Afromowitz | B29D 11/00432 205/70 |
| 2006/0237871 | A1 * | 10/2006 | Uchida | B29C 45/14836 425/116 |
| 2007/0125124 | A1 | 6/2007 | South | |
| 2009/0014910 | A1 * | 1/2009 | Muukkonen | B29C 45/14639 257/E21.526 |
| 2011/0256254 | A1 * | 10/2011 | Yen | B29D 11/0048 425/123 |
| 2012/0093961 | A1 * | 4/2012 | Wang | B29C 45/2675 425/414 |
| 2015/0117939 | A1 * | 4/2015 | Kluge | F16B 35/00 403/299 |
| 2016/0082502 | A1 | 3/2016 | Appleby et al. | |
| 2016/0250778 | A1 * | 9/2016 | Halla | B29C 33/02 264/219 |
| 2018/0001531 | A1 * | 1/2018 | Lawless, III | B29C 45/1782 |
| 2018/0015338 | A1 | 1/2018 | Seluga et al. | |
| 2020/0398460 | A1 * | 12/2020 | Davidson | B29C 70/205 |

* cited by examiner

METHOD OF JOINING TITANIUM AND PRECIOUS METAL AND PRODUCTS OF SAME

BACKGROUND

This United States Non-Provisional Application claims priority to U.S. Provisional Application No. 63/562,851, titled "Method of Joining Titanium and Precious Metal and Products of Same," filed Mar. 8, 2025, the contents of which are incorporated by reference herein in their entirety.

BACKGROUND

In many industries, but particularly the jewelry industry, it is desirable to have pieces of jewelry that incorporate more than one type of metal. Titanium is desirable to use because it is one of the strongest metals, it is corrosion resistant, it is hypoallergenic and less likely to cause allergic reactions, and it is bio-compatible, meaning it can withstand bodily fluids. Gold is also desirable to use in jewelry because it is non-reactive, meaning, it will not react with oxygen or most chemicals and rust/tarnish, it is durable, it is hypoallergenic, conductive to heat, and is malleable. However, joining titanium and gold is difficult and is often achieved by lasering and/or welding, which is time consuming can typically produces unsightly joints between the metals. This makes lasering and/or welding undesirable when it comes to jewelry.

Accordingly, there is a need for a new method of joining titanium and precious metal.

SUMMARY

The present invention addresses this need. In a first embodiment, the present invention is directed to a method of joining titanium and precious metal. The method comprises the steps of: a) providing at least one of the following: i) at least one titanium pin having a shaft portion and a head portion, wherein the head portion has a diameter that is greater than a diameter of the shaft portion; and/or ii) at least one titanium tube having a shaft portion and a head portion, wherein the head portion has a diameter that is greater than a diameter of the shaft portion; b) providing a mold, the mold comprising: i) a first mold half with an interior surface having a design carved therein, forming a design cavity; ii) a second mold half with an interior surface having a central recess disposed therein, the central recess having with a plurality of spaced apart holes disposed therein; iii) a brass insert configured for placement within the central recess of the second mold half, the brass insert having a plurality of spaced apart holes that are configured to align with the spaced apart holes of the recess; c) placing the brass insert into the central recess of the second mold half; d) placing the shaft of at least one pin or tube through at least one of the plurality of holes in the brass insert and into a corresponding hole in the recess; e) closing the first mold half and the second mold half such that the interior surface of the first mold half is proximate the interior surface of the second mold half; f) injecting plastic into the design cavity and forming at least one plastic branch; g) removing the plastic branch from the mold and coupling the branch to a wax rod to form a plastic tree; h) coupling the wax rod to a rubber base; i) placing a metal cylinder around the plastic tree and coupling the cylinder to the rubber base, forming an open top and a closed bottom; j) pouring cement into the open top of the cylinder, surrounding and encasing the plastic tree; k) allowing the cement to harden and cure around the plastic tree; l) removing the rubber base and placing the cylinder in a furnace; m) heating the furnace until the plastic and wax melt out of the cement cylinder, forming a cement cavity; n) turning the cylinder upside down and pouring molten precious metal into the cement cavity; o) once the molten metal has hardened, forming a metal tree with at least one metal branch, removing the cement from around the metal tree; p) removing the at least one metal branch from the metal tree, each metal branch having at least one piece of complete jewelry coupled thereto; and q) removing the at least one piece of complete jewelry from the branch.

Optionally, each piece of complete jewelry comprises at least one titanium pin or at least one titanium tube embedded within precious metal.

Optionally, the precious metal is selected from the group comprising: gold, silver, platinum, palladium, rhodium, iridium, osmium, rhenium, and ruthenium.

In a second embodiment, the present invention is directed to a metal composite comprising: a) a precious metal body portion; and b) a cylindrical titanium portion having a shaft portion and a head portion, wherein the head portion has a diameter that is greater than a diameter of the shaft portion, and the head portion is embedded within the precious metal body.

Optionally, the titanium portion comprises a titanium pin or a titanium tube.

Optionally, the precious metal is selected from the group comprising: gold, silver, platinum, palladium, rhodium, iridium, osmium, rhenium, and ruthenium.

Optionally, the metal composite comprises a labret stud or an earring.

In a third embodiment, the present invention is directed to a mold used to join titanium and precious metal. The mold comprises a) a first mold half with an interior surface having a design carved therein, forming a design cavity; b) a second mold half with an interior surface having a central recess disposed therein, the central recess having with a plurality of spaced apart holes disposed therein; and c) a brass insert configured for placement within the central recess of the second mold half, the brass insert having a plurality of spaced apart holes that are configured to align with the spaced apart holes of the recess.

DRAWINGS

These and other features, aspects, and advantages of the present invention will become better understood with regard to the following description, appended claims, and accompanying drawings.

DESCRIPTION

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

It should be noted that while the figures and the method steps described herein are directed to a method of joining titanium pins or tubes to gold or other precious metal, for either threadless piercings or labrets, this method of joining two different types of metals is not limited to piercings and labrets, and can be used to join titanium to precious metal to produce items/products for use in any field.

Referring now to FIGS. 1A-1E, there is shown a first step in a method of joining titanium and one or more precious metals. The first step comprises creating a design for the item to be manufactured, typically using a CAD (computer aided design) machine to create and determine the specifications for the item. The CAD drawings/files are then used by a CNC mill/machine to produce a metal mold 100A, 100B (FIGS. 1A and 1B) that is based on the design in the CAD files. A CNC mill/machine is a motorized maneuverable tool and often a motorized maneuverable platform, which are both controlled by a computer, according to specific input instructions (CAD files in this case). Note however, that the mold can be made by other means, and is not limited to being made of metal, using CAD files and a CNC machine. The mold can be made from metal, rubber/silicone, plastic, composite materials, or cement, and any combination of the aforementioned. Other methods to make molds may include, but are not limited to, sand casting, loam molding, plaster mold casting, and shell molding.

Figure 1A:
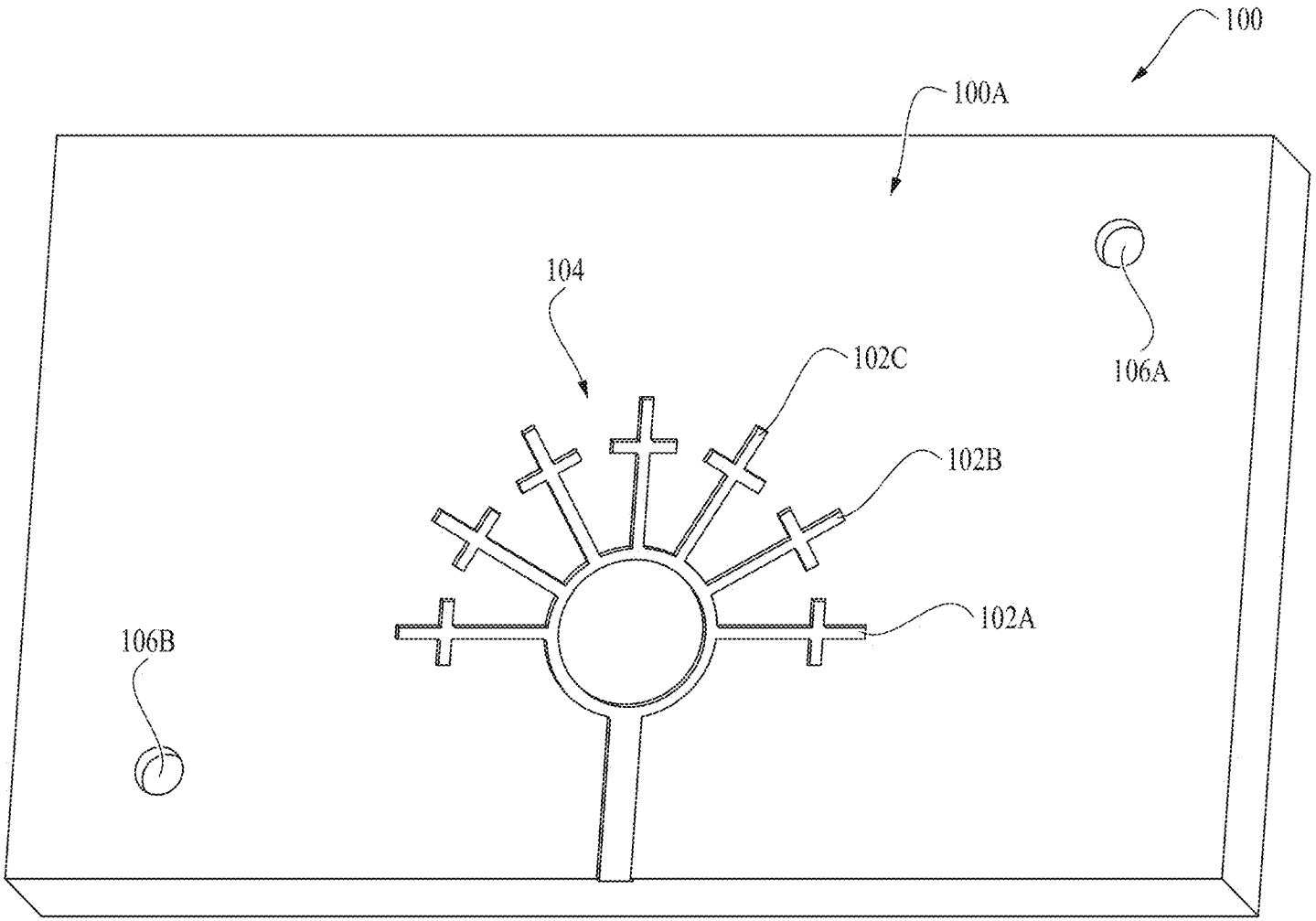
FIG. 1A is a top plan view of a first half of a mold used for a method of joining titanium and one or more precious metal, having features of the present invention.
Figure 1B:
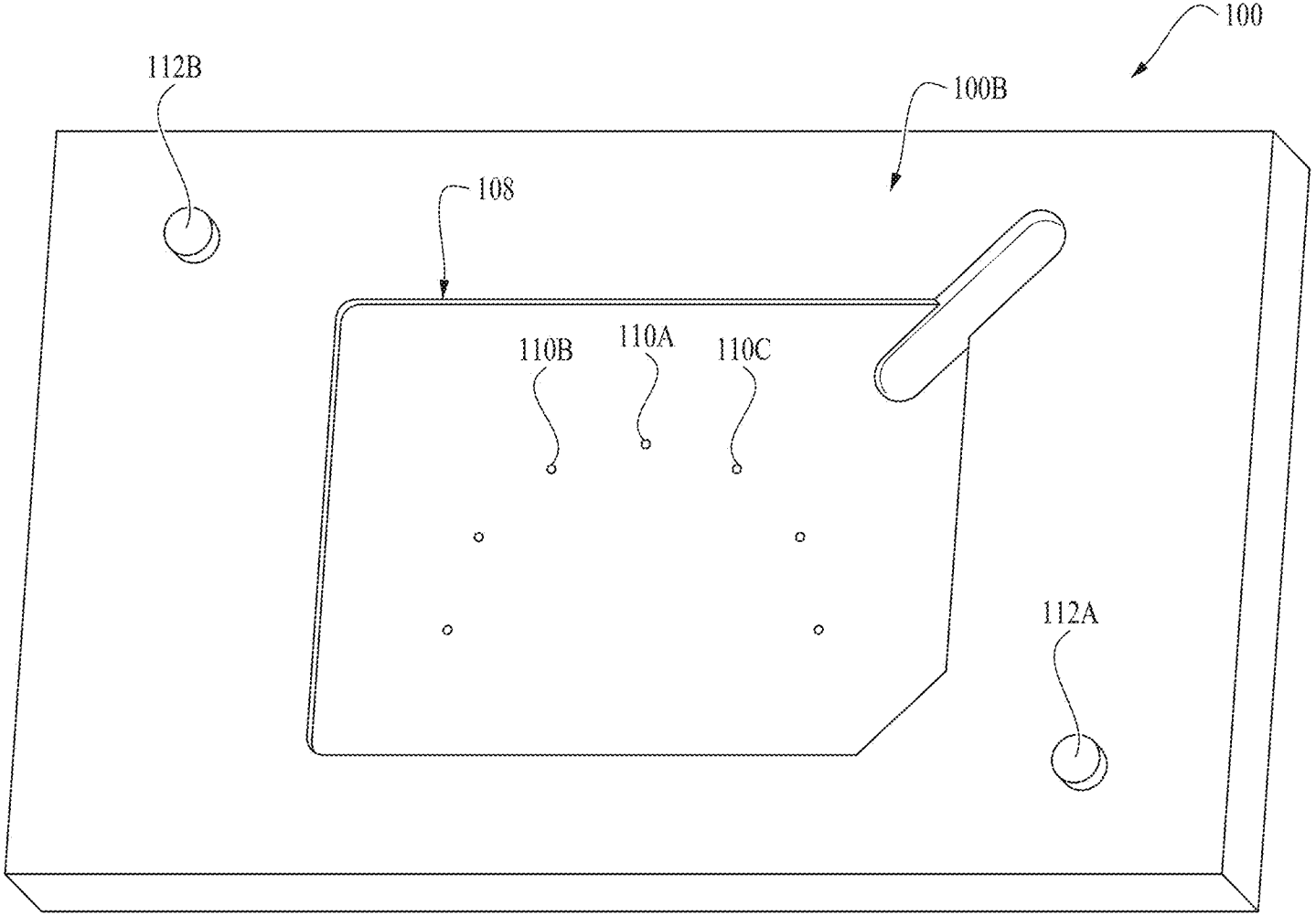
FIG. 1B is a top plan view of a second half of the mold of FIG. 1A.

FIG. 1A shows a first side/half of the mold 100A, and FIG. 1B shows a second side/half of the mold 100B. The first mold half 100A has a design of a finished product 102 etched into it in the form of an intricate recess 104. In FIG. 1A, the finished product is a cross design, and each cross is connected to each other in a circular fashion forming a "branch." The first mold half 100A also includes at least one securing recess, and preferably at least two securing recesses 106A, 106B.

The second mold half 100B has at least one central recess 108 with at least one, but preferably a plurality of spaced apart holes 110. The holes 110 are positioned for receiving titanium pins 200A or titanium tubes 200B, depending on what is being produced. Preferably, the second half of the mold 100B also has at least one, preferably two, securing projections 112A, 112B, which are configured to mate with the securing recesses 106A, 106B in the first half of the mold 100A. The securing recesses 106 and the securing projections 112 mate and keep the two mold halves 100A, 100B properly aligned with each other.

Figure 1C:
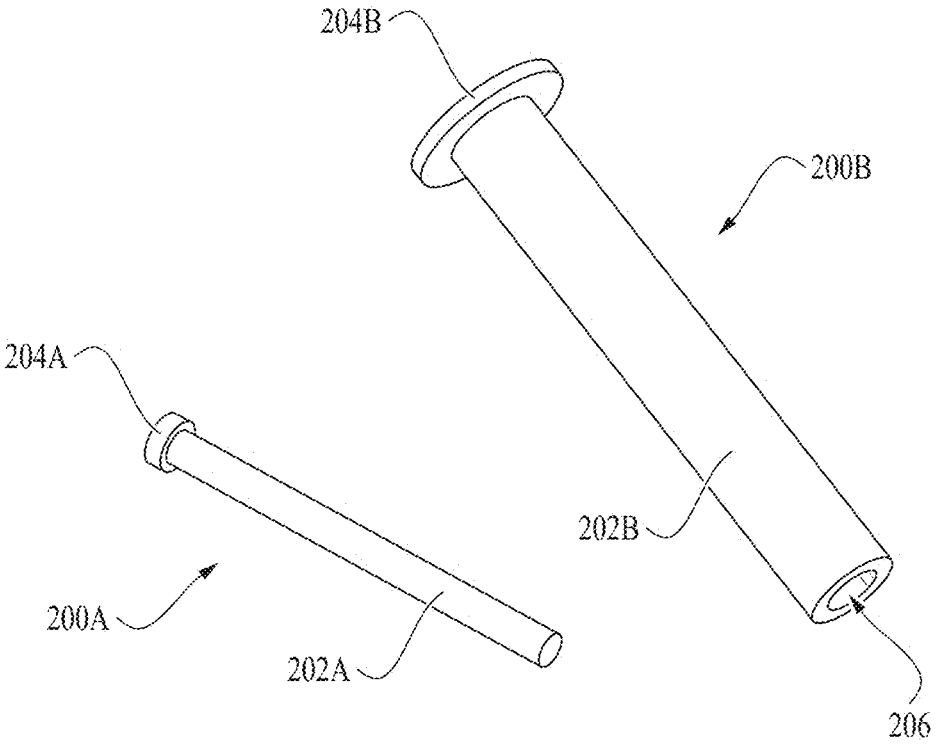
FIG. 1C is a perspective view of a titanium pin and a titanium tube that can be used with the method of the present invention.

FIG. 1C shows an exemplary titanium pin 200A, and a titanium tube 200B that can be used with this method. Note that both the pin 200A, and the tube 200B have cylindrical body portions 202A, 202B and head portions 204A, 204B coupled thereto. The body portion 202A of the pin 200A is solid, while the body portion 202B of the tube 200B is hollow and has an open end 206 disposed opposite the head portion 204B of the tube 200B. The head portions 204A, 204B of the pins 200A and tubes 200B have a diameter that is greater than the diameter of their corresponding body portion 202A, 202B.

Figure 1D:
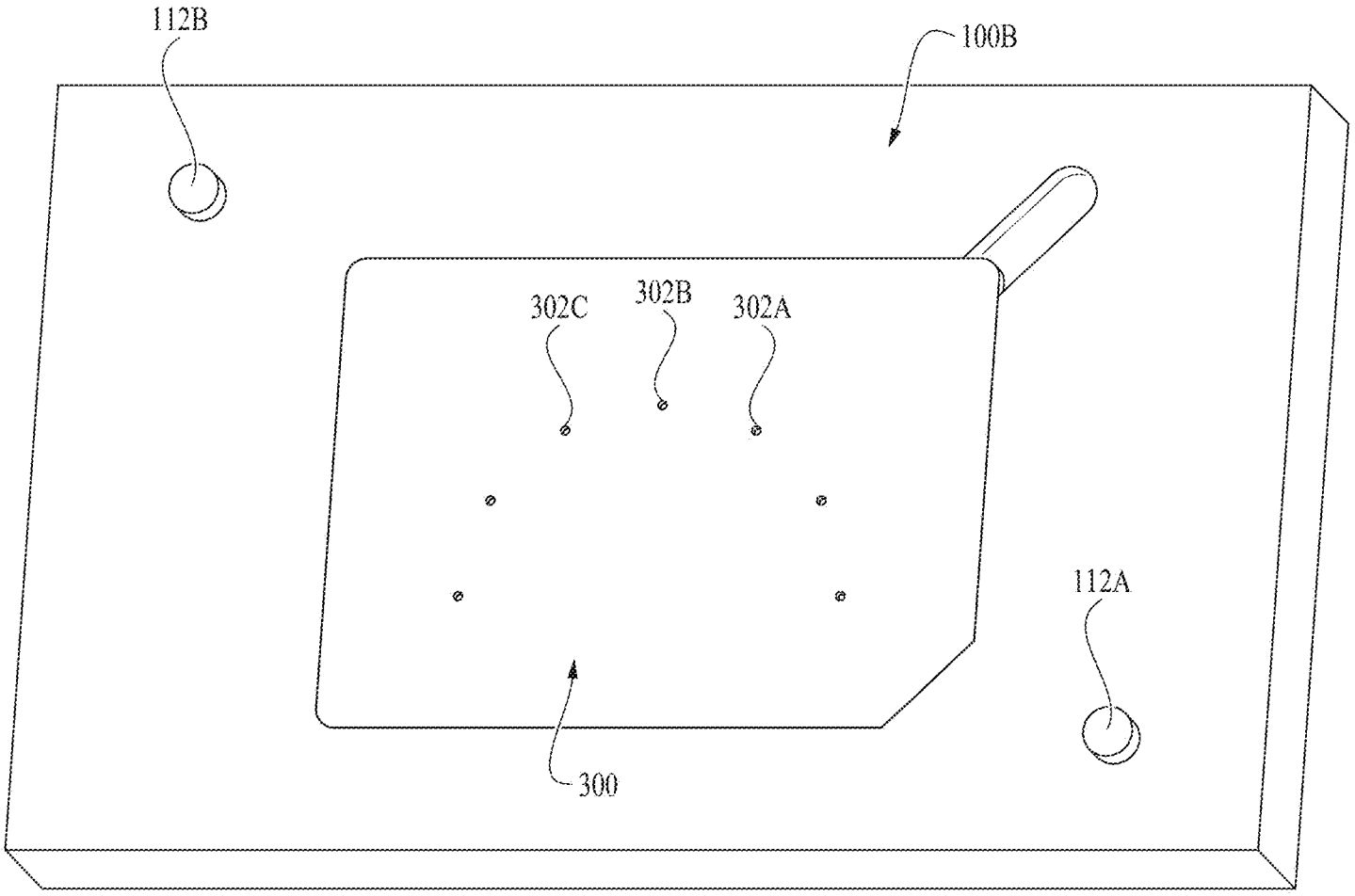
FIG. 1D is a top plan view of a brass plate that is used in the mold of FIGS. 1A and 1B.
Figure 1E:
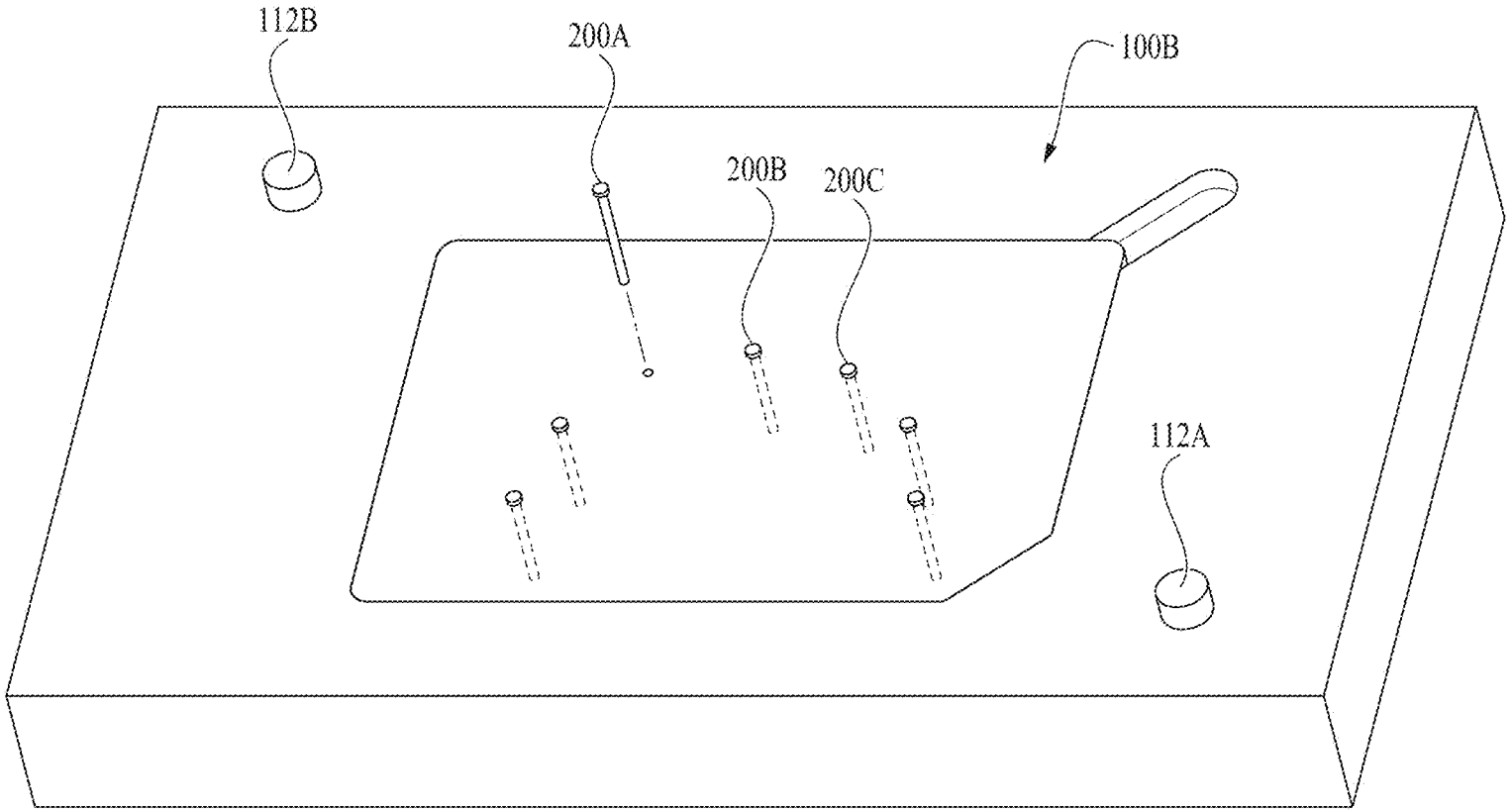
FIG. 1E is a top plan view of the brass plate of FIG. 1D, wherein one of the pins or tubes has been placed therein.

FIG. 1D shows a brass insert 300 that has at least one, but preferably a plurality of holes 302 disposed therethrough. The brass insert 300 is configured to allow the mold 100 to interchange between using pins 200A or tubes 200B, and FIG. 1E shows a pin/tube 200A, 200B inserted in one of the holes 302 in the brass plate 300, wherein the head portion 204A, 204B of the pin/tube 200A, 200B can be seen. The body portion 202A, 202B of the pin/tube 200A, 200B extends down into one of the holes 110 in the second half of the mold 100B. The brass insert 300 is helpful because it assists in securing the head 204A, 204B of the pin/tube 200A, 200B at an appropriate distance from an inner surface of the first half of the mold 100A when the two mold halves 100A, 100B are secured to each other. This ensures that the head 204A, 204B of the pin/tube 200A, 200B is properly and securely positioned within the final product when cast. While the insert 300 is referred to as being made from brass, the insert 300 is not limited to being made from brass and can be made from other materials and/or metals that would be reasonable to use herein.

Figure 2A:
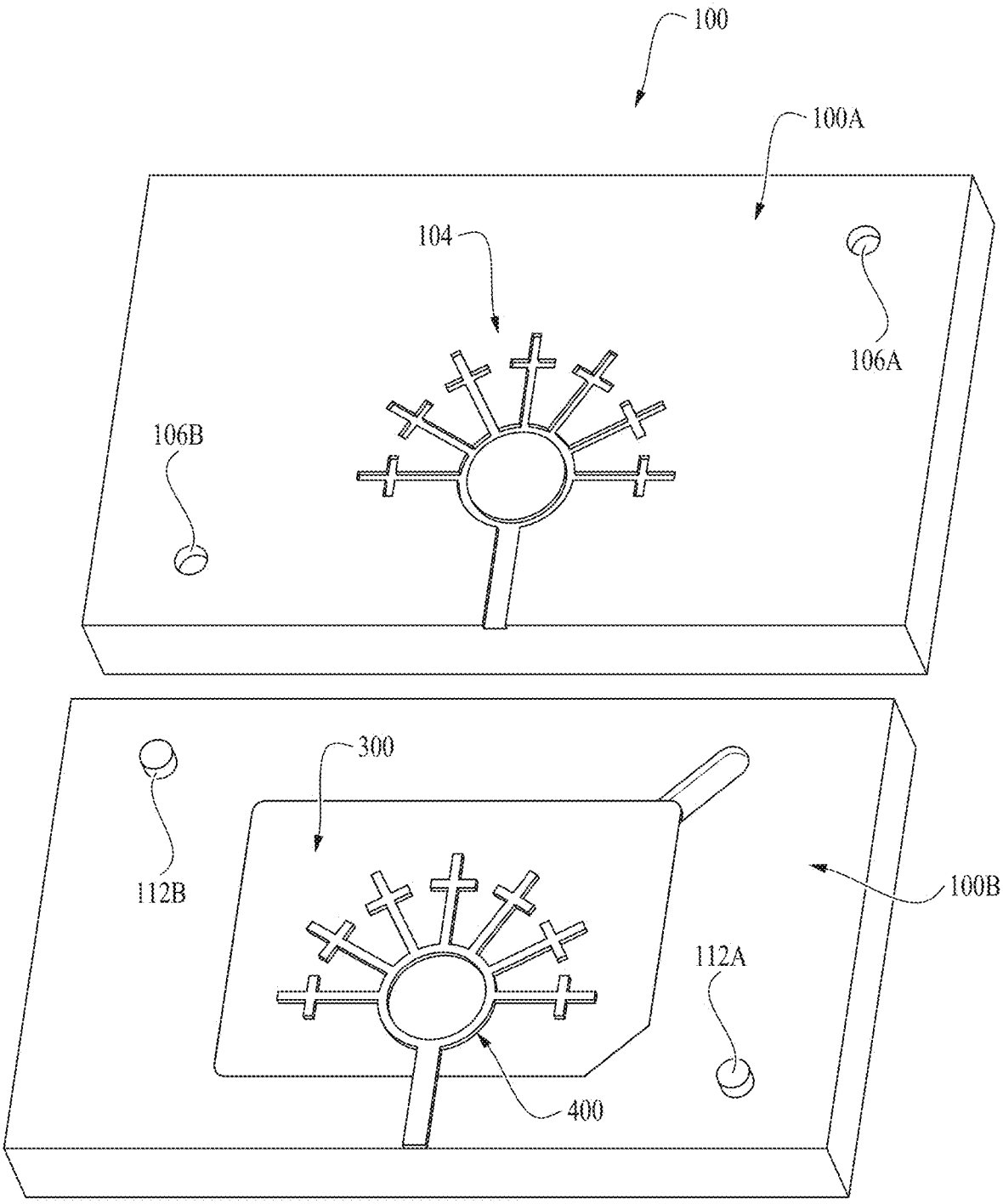
FIG. 2A is a top plan view of a first step of injecting plastic into the mold of FIGS. 1A and 1B, wherein the mold is shown in an open position.
Figure 2B:
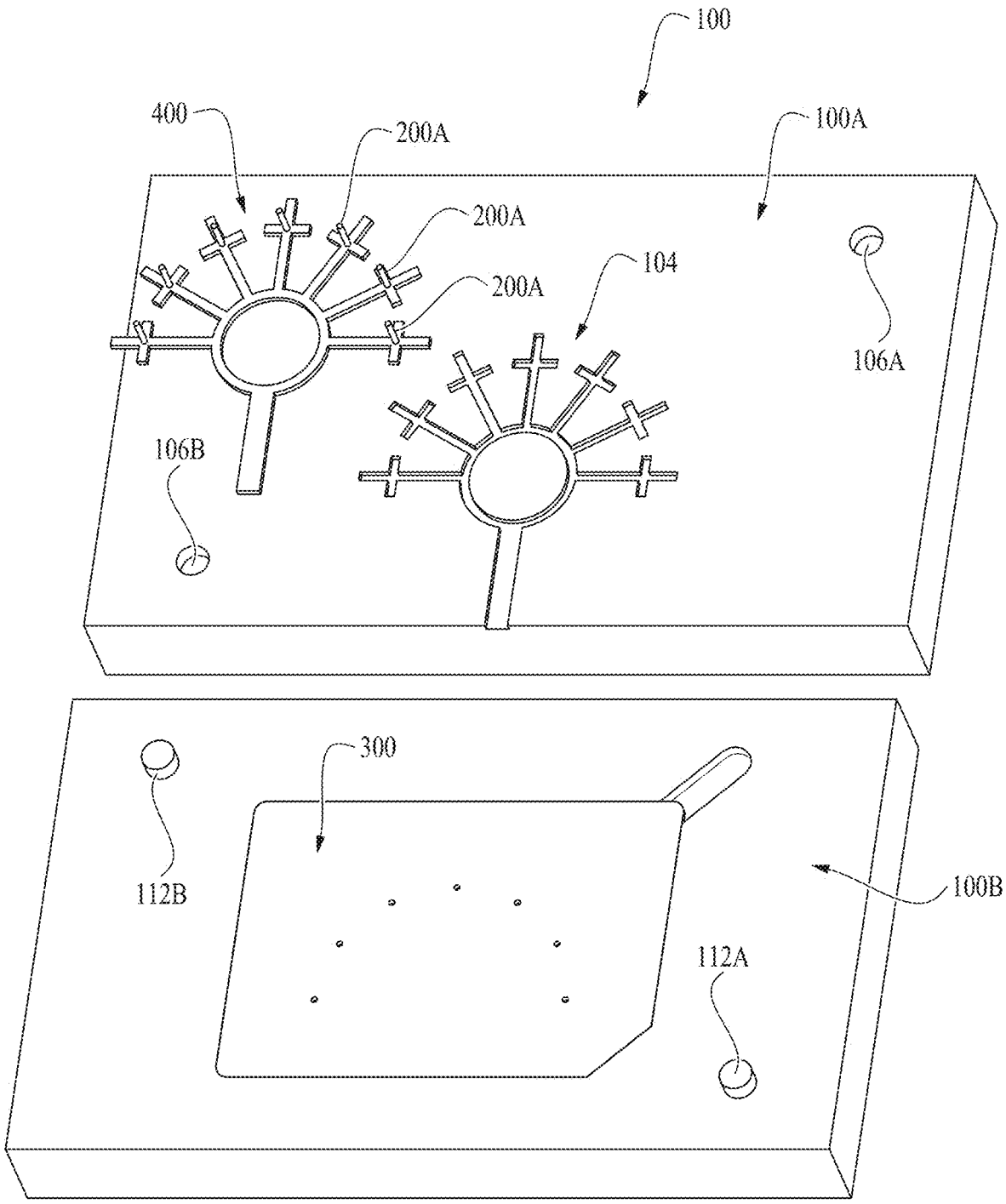
FIG. 2B is a top plan view of the first step shown in FIG. 2A, wherein a plastic form ("branch") has been made and removed from the mold.
Figure 2C:
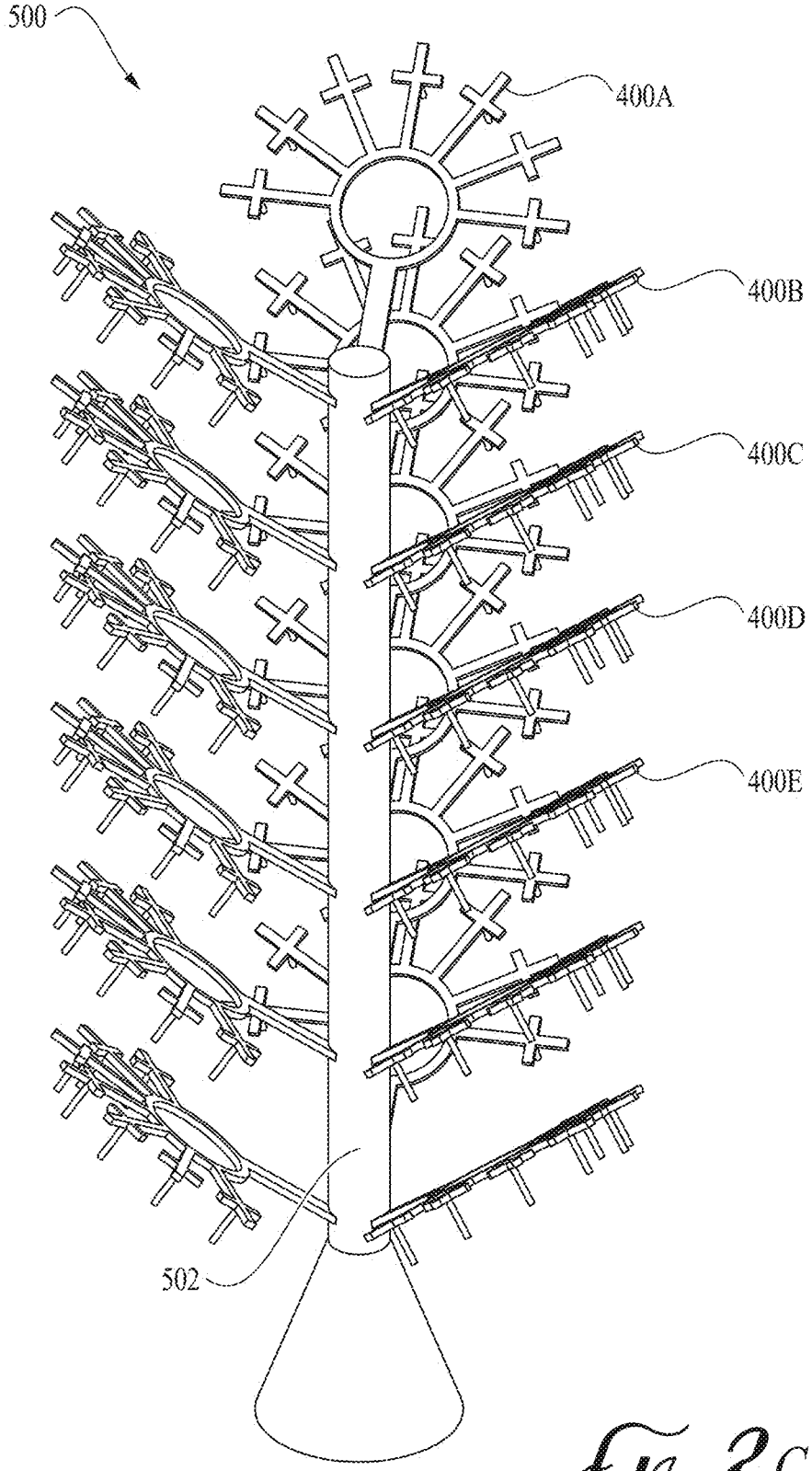
FIG. 2C is a perspective view of a tree, which is used in lost wax casting.

Referring now to FIGS. 2A-2C, once the mold is made by putting the two halves 100A, 100B together, a plastic injector (not shown) is used to inject plastic into a cavity created in the mold 100. The cavity is created by the space between a top surface of the brass plate 300 and the intricate recess 104 carved into the first half of the mold 100A.

Once the plastic hardens around the heads 204A, 204B of the pins/tubes 200A, 200B, the plurality of pins/tubes 200A, 200B are secured within the plastic forms and can now be used to form the finished product via lost wax casting. An example of the completed plastic form 400, with the pins/tubes 200A, 200B embedded therein, is shown in FIG. 2B. Another term for the completed plastic form 400 is "branch." Note that while plastic is shown in this method, the use of plastic or resin is not required. Other mediums can be used such as wax or other material that can melt and be removed from the final mold when heat is applied.

Specifically with respect to the lost wax casting method applied herein, the completed plastic forms 400 shown in FIGS. 2A and 2B are the "branches" that are used to create a "tree," shown in FIG. 2C. An exemplary tree is shown in FIG. 2C. Spruing is the process of attaching each of the plastic forms ("branches) 400 onto a long, tapering wax rod 502. This becomes the "trunk" of the tree 500, supporting many pattern "branches" 400. The plastic tree 500 is rooted in the center of a rubber base 602 that keeps the plastic tree 500 upright and steady as it is built. Additional plastic forms (branches) 400 are attached using a sticky wax or a hot-wax pen.

Figure 2D:
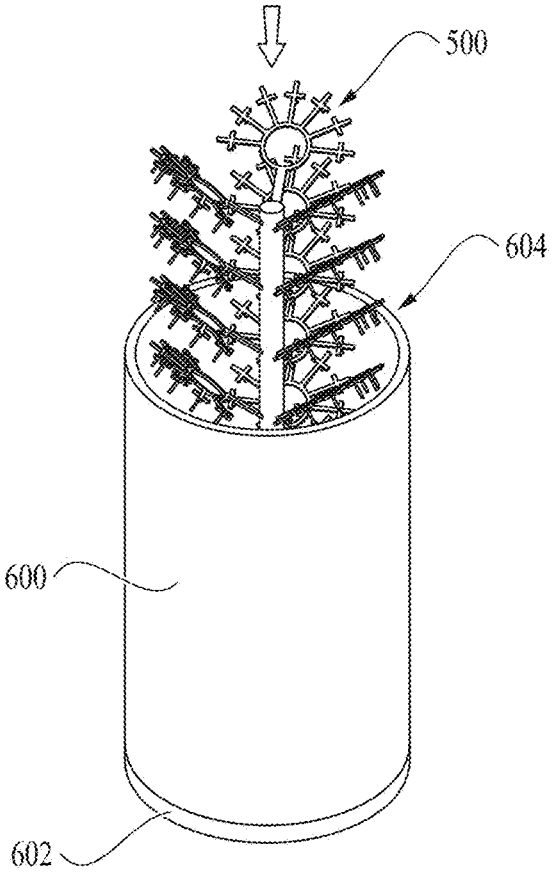
FIG. 2D is a perspective view of placing the tree into a cylinder for lost wax casting.
Figure 2E:
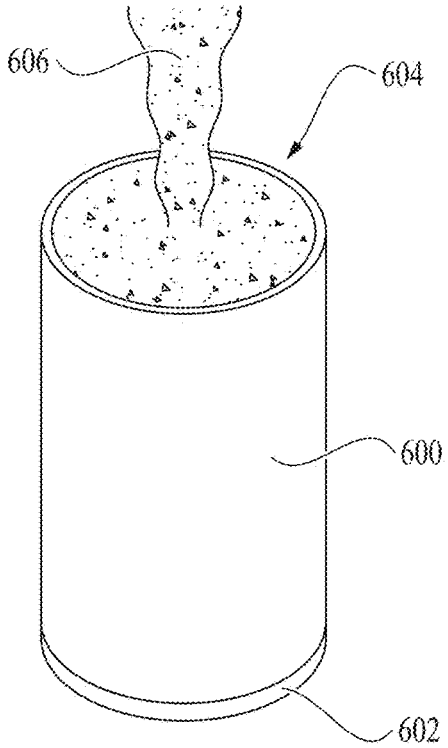
FIG. 2E is a perspective view of adding cement or other material to the cylinder.

Referring now to FIGS. 2D and 2E, after the plastic tree 500 is formed, a hollow cylinder 600, typically made from metal, is placed around the plastic tree 500 and secured to the rubber base 602, forming a cylindrical cavity with an open top 604 and closed bottom (created by the rubber base 604), and the plastic tree 500 standing upright therein. Cement or other hardening material 606 is then poured into the cylinder 600 through the open top until the plastic tree 500 is completely surrounded and submerged. The cement 606 is then left to harden around the plastic tree 500.

Figure 2F:
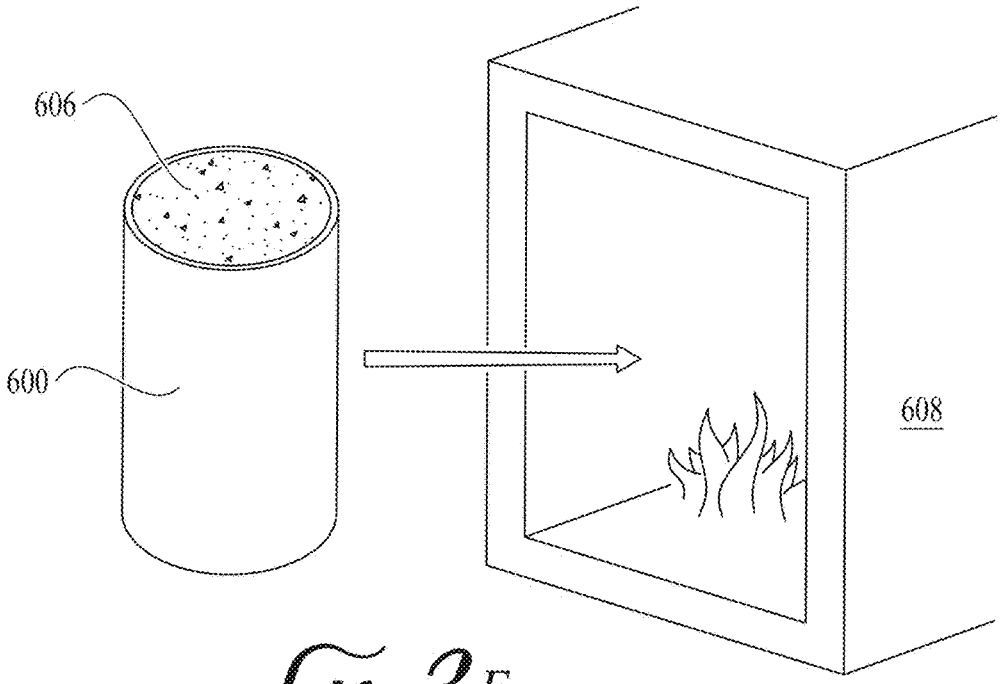
FIG. 2F is a perspective view of placing the filled cylinder into a furnace for heating.

Referring now to FIG. 2F, the rubber base 602 is removed, and the cylinder 600 of cement, with the plastic/wax tree 500 encapsulated therein, is placed in a furnace 608. The heat from the furnace 608 melts the plastic and wax out of the cement cylinder 600, leaving a cavity 610 in the cement 606 into which hot, molten metal can be poured. It should be noted that the titanium pins/tubes 200A, 200B that were embedded in the plastic tree 500 are now secured in the cement 606 and remain behind, precisely positioned within the cement cavity 610.

Figure 2G:
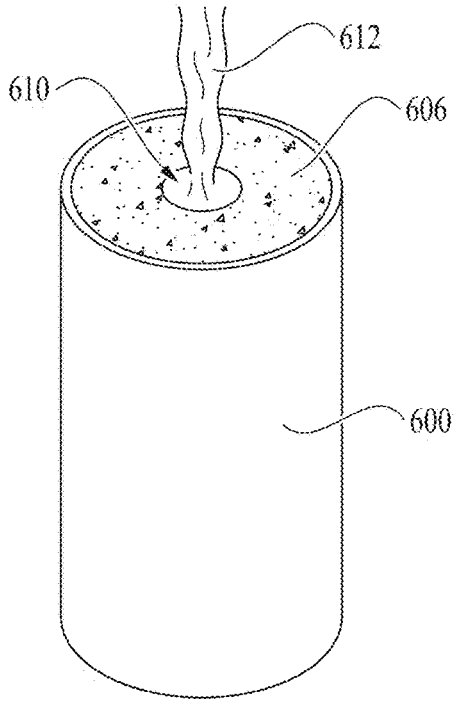
FIG. 2G is a perspective view of pouring metal into the cylinder.

Referring now to FIG. 2G, the hardened cement cylinder 600 is then positioned upside down (so that what was the end with the rubber base 602 is now functioning as an open top) and molten metal 612 (precious metal in this case) is poured into the cavity 610 formed in the cement cylinder 606 and is left to harden around the titanium pins/tubes 200A, 200B that remain therein. Other methods of casting can be used, such as but not limited to, investment casting, waste molding of plaster, and evaporative-pattern casting.

Figure 2H:
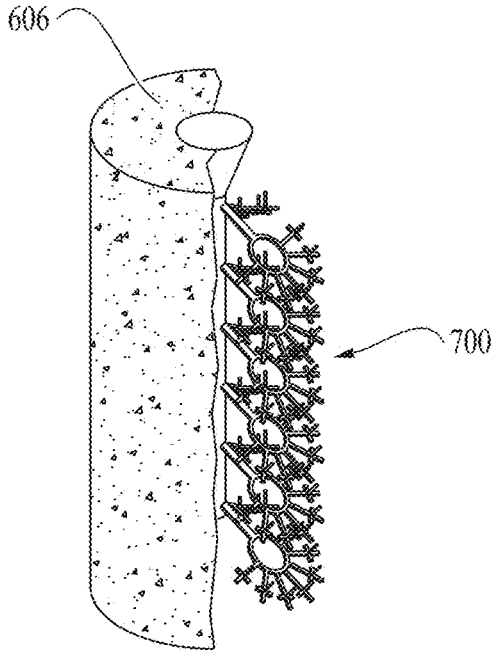
FIG. 2H is a perspective view of removing the cement from around the newly formed metal tree.
Figure 2I:
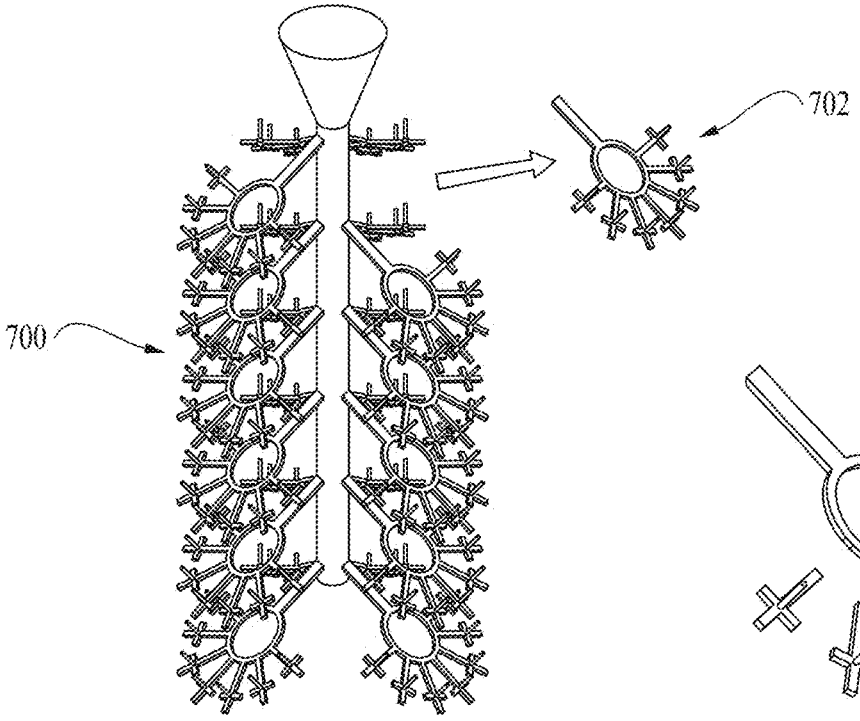
FIG. 2I is a perspective view of removing metal branches from the metal tree.
Figure 2J:
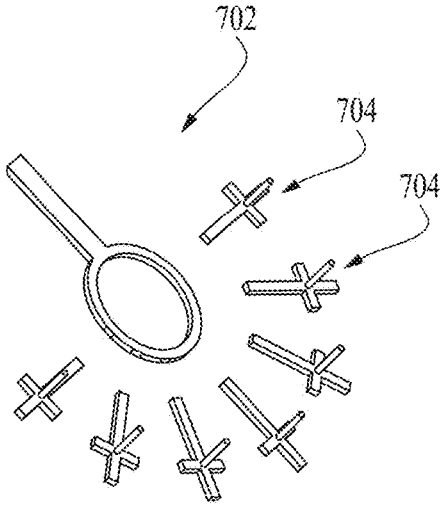
FIG. 2J is a perspective view of removing the completed individual jewelry pieces from each branch.

Referring now to FIG. 2H, once the metal hardens inside the cement cavity 610, the cement 606 is then removed by traditional means known to those skilled in the art, leaving behind a metal "tree" 700 with a plurality of metal branches 702.

Figure 3A:
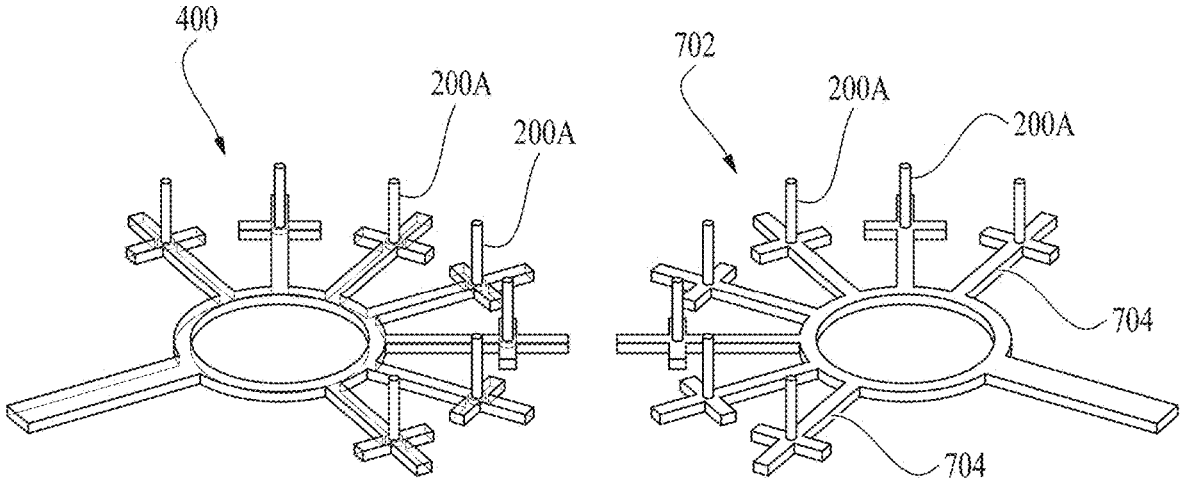
FIG. 3A is a perspective view of the plastic form ("branch") of FIG. 3A, and the finished cast product that is produced using the plastic form of FIG. 3A.
Figure 3B:
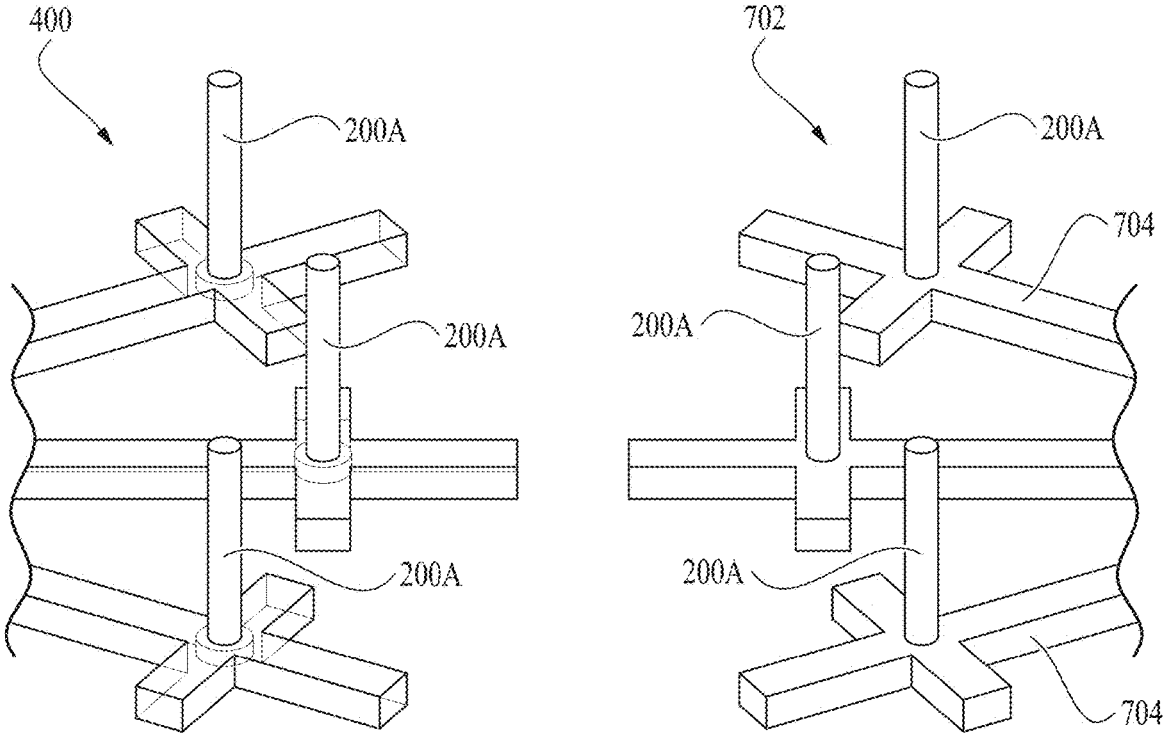
FIG. 3B is a close-up perspective view of the plastic form and finished cast product of FIG. 3A.
Figure 4:
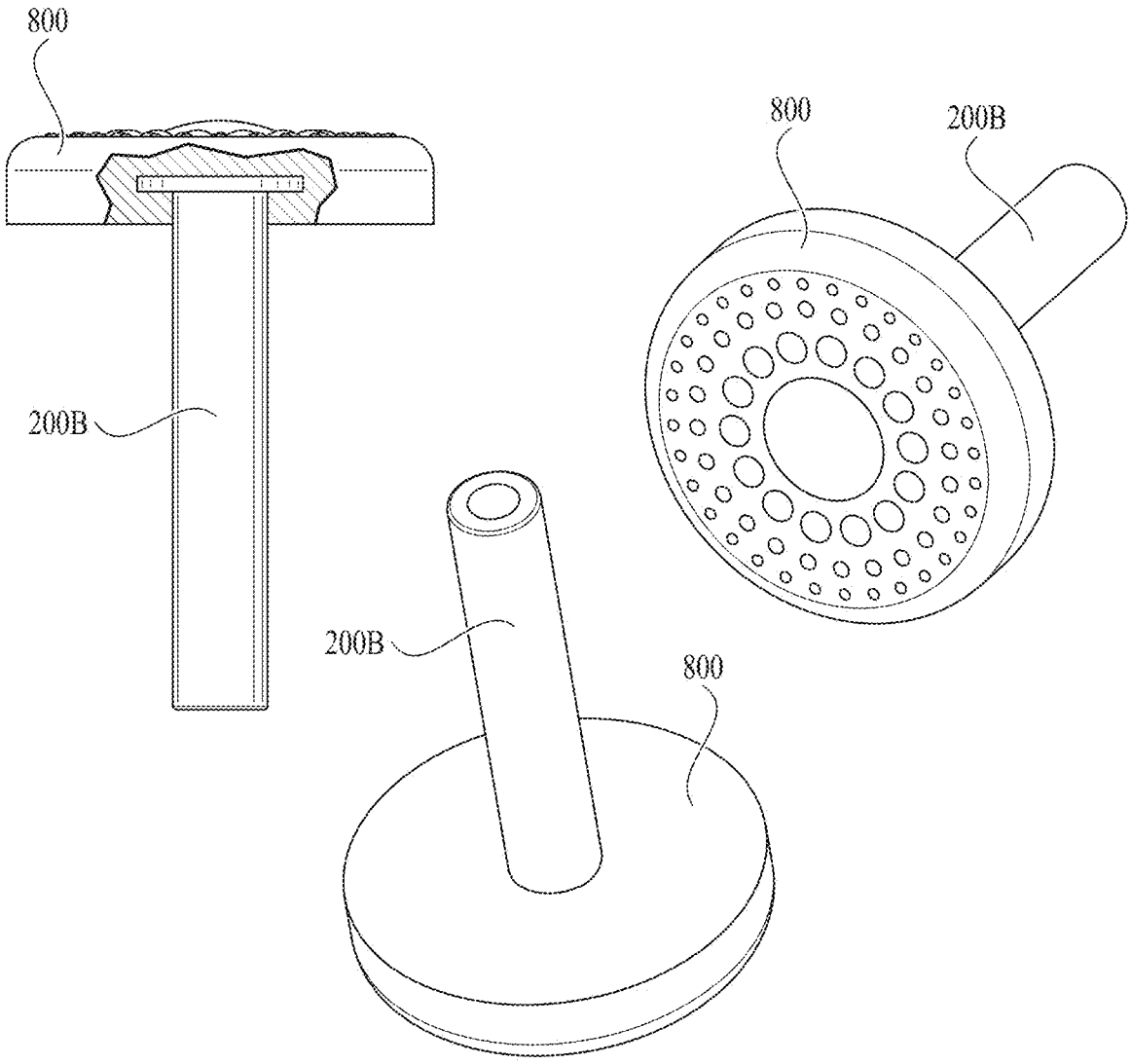
FIG. 4 is a perspective view of one embodiment of the finished cast product, formed by the method of joining titanium ad precious metal disclosed herein.

The branches 702 formed from this metal tree 700 can be seen in FIGS. 3A and 3B wherein both the original plastic forms/branches 400 are shown, and the completed gold forms/branches 702 are shown. Each item/piece of jewelry 704 is then removed from the branches 702. If desired, the finished product 704 it can be polished further if necessary, and gems can be set therein. See FIG. 4 for one embodiment of the completed, finished product, wherein titanium tubes 200B are embedded within gold discs 800.

This method and process is unique because the joints/seams formed between the titanium and precious metal are uniform and smooth. This can be seen in FIG. 4 wherein the demarcation between the titanium tube 200B and the gold disc 800 of the jewelry is nothing more than a fine, clean line. Known methods of joining titanium and precious metal involve lasering and/or welding titanium to precious metal, and this results in unsightly, rough joints between the two metals that are difficult to sand down and smooth out.

Moreover, the method of the present invention permits high speed, mass manufacturing because of the use of the lost wax method to secure the titanium to the precious metal. Additionally, no extra "clean up" step is required to make sure the joint between the two metals is sightly because it comes out clean and generally finished from the lost wax casting method.

In contrast, the known method of lasering and/or welding must be done by hand and is extremely time consuming from both the hands-on aspect and the extra "clean up" step that is required after lasering/welding. Accordingly, the method of the present invention can reduce manufacturing costs and increase manufacturing speed.

Additionally, the configuration of the pins/tubes 200A, 200B is important because the larger diameter head portions 204A, 204B allow the precious metal to surround and then shrink and solidify around the head portions 204A, 204B, reducing the chance of the pins/tubes 200A, 200B being pulled out of/removed from the precious metal they are seated within.

While the present method/finished products are directed to titanium pins/tubes secured within precious metal, this method is not limited to those specific structures, and the more general concept of securing titanium within precious metal by allowing the precious metal to surround and shrink/solidify around the titanium is what is disclosed herein. The titanium portion does not need to be in the specific form of a rod or pin or tube. All that is required is that the titanium portion have a head portion that is larger in diameter/size than the rest of the titanium portion so that the head portion can be embedded within the precious metal. Precious metals that can be used with this technique include but are not limited to gold, silver, platinum, palladium, rhodium, iridium, osmium, rhenium, and ruthenium.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference.

What is claimed is:

1. A mold used to form at least one branch for use in lost wax cast molding, the mold comprising:

a. a first mold half with an interior surface having a design cavity carved therein, the design cavity configured to form the at least one branch, the design cavity having a first shape;

b. a second mold half with an interior surface having a central recess disposed therein, the central recess having a second shape, with a first plurality of spaced apart holes disposed therein, wherein the first plurality of holes are aligned with the design cavity of the first mold half; and c. a brass insert configured for placement within the central recess of the second mold half, the brass insert having a second plurality of spaced apart holes that are configured to align with the first plurality of spaced apart holes of the central recess when the brass insert is placed within the central recess;

wherein the first shape of the design cavity of the first mold half is different than the second shape of the central recess of the second mold half.

2. The mold of claim 1, wherein the central recess of the second mold half has an open top and a closed bottom.

3. The mold of claim 1, wherein the brass insert is configured to fit entirely within the central recess of the second mold half.

4. The mold of claim 1, wherein the brass insert is retained within the second mold half after use of the mold to make the at least one branch.

5. The mold of claim 1, wherein one half of the mold has at least one securing projection and an other half of the mold has at least one securing recess, wherein the at least one securing projection and the least one securing recess are configured to mate with each other.

6. The mold of claim 1, wherein the design cavity in the first half of the mold comprises a single open end configured to allow injection of material into the deign cavity when the first and second mold halves are mated together.

7. The mold of claim 1, further comprising at least one titanium pin for insertion through at least one of the second plurality of holes in the brass insert, each rod having a solid shaft portion and a head portion, wherein the head portion is coupled to one end of the shaft, and each head portion has a diameter that is greater than a diameter of its corresponding shaft portion.

8. The mold of claim 1, further comprising at least one titanium tube for insertion through at least one of the second plurality of holes in the brass insert, each tube having a hollow shaft portion and a head portion, wherein the head portion is coupled to one end of the shaft, forming a closed end, and each head portion has a diameter that is greater than a diameter of its corresponding shaft portion.

9. A method of using the mold of claim 1 to join titanium and precious metal, the method comprising the steps of:

a. providing at least one of the following:

i. at least one titanium pin having a shaft portion and a head portion, wherein the head portion has a diameter that is greater than a diameter of the shaft portion; and/or ii. at least one titanium tube having a shaft portion and a head portion, wherein the head portion has a diameter that is greater than a diameter of the shaft portion;

b. providing the mold of claim 1;

c. placing the brass insert into the central recess of the second mold half, d. placing the shaft of at least one pin or tube through at least one of the plurality of holes in the brass insert and into a corresponding hole in the recess;

e. closing the first mold half and the second mold half such that the interior surface of the first mold half is proximate the interior surface of the second mold half, f. injecting plastic into the design cavity and forming at least one plastic branch;

g. removing the plastic branch from the mold and coupling the branch to a wax rod to form a plastic tree;

h. coupling the wax rod to a rubber base;

i. placing a metal cylinder around the plastic tree and coupling the cylinder to the rubber base, forming an open top and a closed bottom;

j. pouring cement into the open top of the cylinder, surrounding and encasing the plastic tree;

k. allowing the cement to harden and cure around the plastic tree;

l. removing the rubber base and placing the cylinder in a furnace;

m. heating the furnace until the plastic and wax melt out of the cement cylinder, forming a cement cavity;

n. turning the cylinder upside down and pouring molten precious metal into the cement cavity;

o. once the molten metal has hardened, forming a metal tree with at least one metal branch, removing the cement from around the metal tree;

p. removing the at least one metal branch from the metal tree, each metal branch having at least one piece of complete jewelry coupled thereto; and q. removing the at least one piece of complete jewelry from the branch.

10. The method of claim 9, wherein each piece of complete jewelry comprises at least a portion of at least one titanium pin or at least one titanium tube embedded within precious metal.

11. The method of claim 9, wherein the precious metal is selected from the group comprising: gold, silver, platinum, palladium, rhodium, iridium, osmium, rhenium, and ruthenium.

* * * * *